US010405586B2

(12) United States Patent
Groth

(10) Patent No.: US 10,405,586 B2
(45) Date of Patent: Sep. 10, 2019

(54) COLLAR SHAPING DEVICE FOR SHIRTS

(71) Applicant: Peak Appearance, LLC, Indianapolis, IN (US)

(72) Inventor: Steven D. Groth, Zionsville, IN (US)

(73) Assignee: PEAK APPEARANCE, LLC, Indianapolis, IN (US)

( * ) Notice: Subject to any disclaimer, the term of this patent is extended or adjusted under 35 U.S.C. 154(b) by 311 days.

(21) Appl. No.: 15/218,533

(22) Filed: Jul. 25, 2016

(65) Prior Publication Data

US 2017/0027238 A1 Feb. 2, 2017

Related U.S. Application Data

(60) Provisional application No. 62/199,041, filed on Jul. 30, 2015.

(51) Int. Cl.
*A41B 3/06* (2006.01)

(52) U.S. Cl.
CPC ..... *A41B 3/06* (2013.01)

(58) Field of Classification Search
CPC ..... A41B 3/02; A41B 3/06; A45F 5/022
USPC ..... 2/250
See application file for complete search history.

(56) References Cited

U.S. PATENT DOCUMENTS

| | | | | |
|---|---|---|---|---|
| 83,973 A | | 11/1868 | Kaufman | |
| 443,023 A | | 12/1890 | Weir | |
| 579,788 A | * | 3/1897 | Brodeur | A41B 3/06 2/132 |
| 714,461 A | | 11/1902 | Dieter | |
| 892,604 A | | 7/1908 | Meehan | |
| 902,576 A | | 11/1908 | Gustafson | |
| D44,319 S | | 7/1913 | Murphy | |
| 1,820,287 A | * | 8/1931 | Morck | A41B 3/06 2/116 |
| 2,304,464 A | | 12/1943 | Manaster | |
| 2,438,325 A | | 3/1948 | Pophal | |

(Continued)

FOREIGN PATENT DOCUMENTS

GB 969758 9/1964

OTHER PUBLICATIONS

"Standard Wire Gauge Conversions" Pryomation Inc. Web. Accessed Jan. 22, 2019. https://www.pyromation.com/Catalog/W03.pdf.*

*Primary Examiner* — Anne M Kozak
(74) *Attorney, Agent, or Firm* — Bose McKinney & Evans LLP

(57) ABSTRACT

A collar shaping device having a U-shaped body adapted to be positioned under the collar of a shirt. The U-shaped body defines a central portion and first and second legs extending therefrom and undulates in a vertical direction. The central portion defines an upper rear contact region that engages the underside of the collar at the midpoint of the central portion. The first and second legs each have a proximate region connected with the central portion and a freely extending distal region. The proximate regions of the first and second legs defines a lower contact region that engages the upper shoulder area of shirt body while the distal regions of the first and second legs defines an upper forward contact region that engages the underside of the collar proximate the forward ends of the collar. Shirt assemblies and methods employing such devices are also disclosed.

22 Claims, 10 Drawing Sheets

(56) References Cited

U.S. PATENT DOCUMENTS

| | | | | | |
|---|---|---|---|---|---|
| 2,439,088 | A | * | 4/1948 | Herr | A41B 3/06 2/132 |
| 2,551,879 | A | | 5/1951 | Freedman | |
| 2,610,774 | A | | 9/1952 | Calder | |
| 2,655,659 | A | * | 10/1953 | Swearingen | A41D 13/046 2/52 |
| 2,659,892 | A | | 11/1953 | Sharp et al. | |
| 2,719,657 | A | | 10/1955 | Allen et al. | |
| 2,799,024 | A | | 7/1957 | Oscard | |
| 2,823,839 | A | | 2/1958 | Bunch | |
| 2,864,540 | A | | 12/1958 | Kass | |
| 2,880,928 | A | | 4/1959 | Merrill | |
| 3,233,799 | A | | 2/1966 | Abbey | |
| 3,318,498 | A | | 5/1967 | Younglove | |
| 3,738,548 | A | | 6/1973 | Lojinger | |
| 4,118,803 | A | | 10/1978 | Blau | |
| 4,133,463 | A | | 1/1979 | Bourrian | |
| 4,669,642 | A | | 6/1987 | Nicholas | |
| 4,922,553 | A | | 5/1990 | Morrone | |
| 5,940,882 | A | | 8/1999 | Auguste | |
| 6,089,422 | A | | 7/2000 | Gibson | |
| 7,004,361 | B2 | | 2/2006 | Thomas | |
| 8,296,865 | B2 | | 10/2012 | Garcia | |
| 8,813,264 | B2 | | 8/2014 | Boos | |
| 8,973,165 | B1 | | 3/2015 | Zaki | |
| 9,307,791 | B2 | | 4/2016 | Garcia | |
| 9,320,302 | B2 | | 4/2016 | English | |
| 2007/0277293 | A1 | | 12/2007 | Koepp | |
| 2011/0113526 | A1 | | 5/2011 | Harris | |
| 2013/0269078 | A1 | | 10/2013 | Andrade et al. | |
| 2014/0223640 | A1 | | 8/2014 | English | |

* cited by examiner

COLLAR SHAPING DEVICE FOR SHIRTS

CROSS REFERENCE TO RELATED APPLICATIONS

This application claims priority under 35 U.S.C. 119(e) of U.S. provisional patent application Ser. No. 62/199,041 filed on Jul. 30, 2015 entitled COLLAR-SHAPING DEVICE FOR MEN'S DRESS AND CASUAL SHIRTS the disclosure of which is hereby incorporated herein by reference.

BACKGROUND OF THE INVENTION

Men's dress shirts, and especially the collars, have evolved greatly over the past 200 years. Many different designs and devices have been created in order to attain a collar that appears crisp and professional. In recent years, many businesses and professions have reduced the formality of the required attire, adopting a dress code commonly known as business casual for many situations. Many modern dress shirts are based on a design that relies on being worn with a tie in order to keep the collar closed around the neck. Even collared shirts that are not intended to be worn with ties are often based on a similar design. Shirts that are worn without a tie, leaving the top one or two buttons unbuttoned, often look sloppy. One problem that often arises is that the collars lie flat. Another problem is that the collars spread outward creating an undesirable appearance.

Numerous methods have been attempted to improve the appearance of the collars of dress shirts that are worn without a tie, or similarly designed casual shirts. Of course, ironing with starch helps make the collars look more crisp, but this look may not last all day and provides limited control on the height and shape of the collar, which is mostly determined by the crease designed into the shirt. It also requires time and/or expense to iron and starch the collar.

Many methods are based on a design that creates an attachment between the collar and the shirt body. One example of this method is the button-down collar. Some methods shape the collar by using adhesives to attach the collar to the shirt body. For example, U.S. Pat. No. 7,004,361 B2 issued Feb. 28, 2006 to Thomas discloses the use of a collar-shaping device that employs an adhesive coating.

Magnetic collar stays have also been proposed. For example, U.S. Pat. No. 8,813,264 B2 issued Aug. 26, 2014 to Boos discloses an apparatus for magnetically holding a shirt collar in a position and orientation on a shirt front.

While many of the known methods and devices are useful, improvements in collar shaping devices are desirable.

SUMMARY OF THE INVENTION

The present invention provides a collar shaping device that is effective and which is both comfortable and convenient to use. The user can employ a single device with all of their shirts that would benefit from the use of the device, simply removing the device from a first shirt when the user takes off the first shirt and using the device with a second shirt when the user puts on the second shirt and so on.

The invention comprises, in one form thereof, a collar shaping device for use with a shirt wearable by a user. The shirt has a collar and a shirt body with the collar having an underside facing the shirt body and an upper crease along which the collar is folded. The shirt body includes upper shoulder regions disposed under opposite sides of the collar when the shirt is being worn by a user. The device includes a U-shaped body that is adapted to be positioned under the collar when the shirt is being worn by the user. The U-shaped body defines a central portion and first and second legs extending from opposite ends of the central portion. The central portion defines an upper rear contact region adapted to engage the underside of the collar at the upper crease of the collar at the midpoint of the central portion. The first and second legs each have a proximate region connected with the central portion and a freely extending distal region. The proximate region of each of the first and second legs defines a lower contact region adapted to engage the upper shoulder area of shirt body while the distal region of each of the first and second legs defines an upper forward contact region adapted to engage the underside of the collar at the upper crease of the collar. The U-shaped body undulates in a vertical direction from the upper forward contact region of the first leg through the lower contact region of the first leg, the upper rear contact region of the central portion, the lower contact region of the second leg to the upper forward contact region of the second leg to thereby define a vertically serpentine shape.

In some embodiments, the U-shaped body defines a length with the U-shaped body having a consistent cross sectional profile along the entire length of the U-shaped body. In such an embodiment, the U-shaped body may advantageously take the form of an elongate, malleable, metal material. For example, the U-shaped body may be a spring steel wire. For example, the U-shaped body may be an American Iron and Steel Institute (AISI) 302/304 stainless steel wire having a diameter of 0.625 inches. In the various embodiments of the device, the U-shaped body may be formed entirely out of a malleable material.

In some embodiments, when the U-shaped body is positioned under the collar when the shirt is being worn by the user, the free ends of the distal regions of the first and second legs extend downward from the upper forward contact region toward the shirt body and back toward the central portion. In other embodiments, when the U-shaped body is positioned under the collar when the shirt is being worn by the user, the free ends of the distal regions of the first and second legs extend downward from the upper forward contact region toward the shirt body and forward away from the central portion whereby the free ends are adapted to be inserted into collar stay pockets located on the collar.

In some embodiments, the U-shaped body is at least partially formed out of a malleable material and can be manually reshaped whereby the distal regions can be repositioned relative to each other to thereby alter a lateral distance between the upper contact regions of the first and second legs. Similarly, in some embodiments, the U-shaped body is at least partially formed out of a malleable material and can be manually reshaped whereby the distal regions can repositioned relative to the lower contact regions to thereby alter a vertical height between the upper contact regions and the lower contact regions. In such an embodiment providing for the adjustment of the vertical height, the U-shaped body may, advantageously, also allow for the U-shaped body to be manually reshaped whereby the distal regions can repositioned relative to each other to thereby alter a lateral distance between the upper contact regions of the first and second legs.

In some embodiments, when the U-shaped body is positioned under the collar when the shirt is being worn by the user, the U-shaped body extending between and connecting the lower contact regions is configured to be spaced upwardly from the shirt body. In such an embodiment, when the U-shaped body is positioned under the collar when the shirt is being worn by the user, the U-shaped body forming the first leg between the lower contact region and the upper contact region and the U-shaped body forming the second leg between the lower contact region and the upper contact region may also be configured to be spaced upwardly from the shirt body.

The invention, in another form thereof, comprises a shirt assembly adapted to be worn by a user that includes both a shirt and a collar shaping device. The shirt has a collar and a shirt body wherein the collar has an underside facing the shirt body and an upper crease along which the collar is folded. The shirt body includes upper shoulder regions disposed under opposite sides of the collar when the shirt is being worn by a user. The collar shaping device having a U-shaped body and configured to be positioned under the collar when the shirt assembly is being worn by the user. The U-shaped body defines a central portion and first and second legs extending from opposite ends of the central portion. The central portion defines an upper rear contact region adapted to engage the underside of the collar at the upper crease of the collar at the midpoint of the central portion. The first and second legs each have a proximate region connected with the central portion and a freely extending distal region. The proximate region of each of the first and second legs defines a lower contact region adapted to engage the upper shoulder area of the shirt body. The distal region of each of the first and second legs defines an upper forward contact region adapted to engage the underside of the collar at the upper crease of the collar. The U-shaped body undulates in a vertical direction from the upper forward contact region of the first leg through the lower contact region of the first leg, the upper rear contact region of the central portion, the lower contact region of the second leg to the upper forward contact region of the second leg to thereby define a vertically serpentine shape.

The collar shaping device used with the shirt assembly may take various forms as described above and as further described below.

The invention comprises, in yet another form thereof, a method of shaping a collar on a shirt being worn by a user wherein the shirt further includes a shirt body with upper shoulder areas disposed under opposite sides of the collar and the collar has an underside facing the shirt body and an upper crease along with the collar is folded. The method includes providing an elongate body and forming the elongate body into a U-shaped body having a central portion and first and second legs extending from opposite sides of the central portion and forming vertical undulations in the U-shaped body wherein the U-shaped body undulates in a vertical direction from an upper forward contact region of the first leg through a lower contact region of the first leg, an upper rear contact region of the central portion, a lower contact region of the second leg to an upper forward contact region of the second leg to thereby define a vertically serpentine shape. The method also involves engaging the underside of the collar at the upper crease of the collar at the midpoint of the collar with the upper rear contact region of the central portion to thereby bias the midpoint of the collar upwardly; engaging the underside of the collar at the upper crease of the collar proximate opposite ends of the collar with the upper forward contact regions disposed on the first and second legs of the U-shaped body to thereby bias the opposite ends of the collar upwardly; and engaging the shirt body at the upper shoulder areas with the lower contact regions disposed on the first and second legs to thereby provide a support for the U-shaped body, the lower contact region of the first leg being disposed between the upper forward contact region of the first leg and the upper rear contact region, the lower contact region of the second leg being disposed between the upper forward contact region of the second leg and the upper rear contact region whereby the engagement of the lower contact regions with the shirt body act as a fulcrum with forces generated by the engagement of the upper rear contact region balancing forces generated by the engagement of the upper forward contact regions.

In some embodiments, the step of providing an elongate body involves providing a length of malleable metal wire.

The collar shaping device used with the method may take various forms as described above and as further described below.

BRIEF DESCRIPTION OF THE DRAWINGS

The above mentioned and other features of this invention, and the manner of attaining them, will become more apparent and the invention itself will be better understood by reference to the following description of embodiments of the invention taken in conjunction with the accompanying drawings, wherein.

Figure 1:
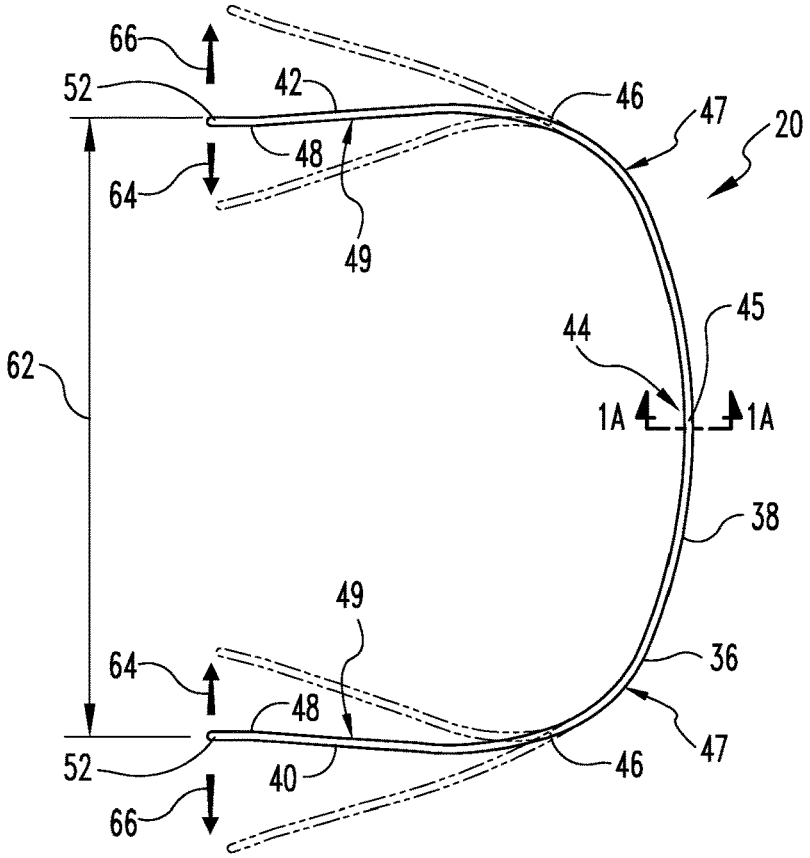
FIG. 1 is a top view of a collar shaping device.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION OF THE INVENTION

Figure 2:
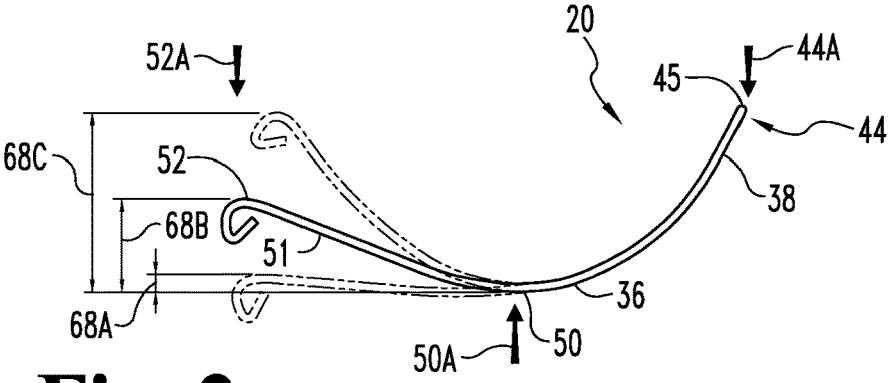
FIG. 2 is a side view of the device of FIG. 1.
Figure 3:
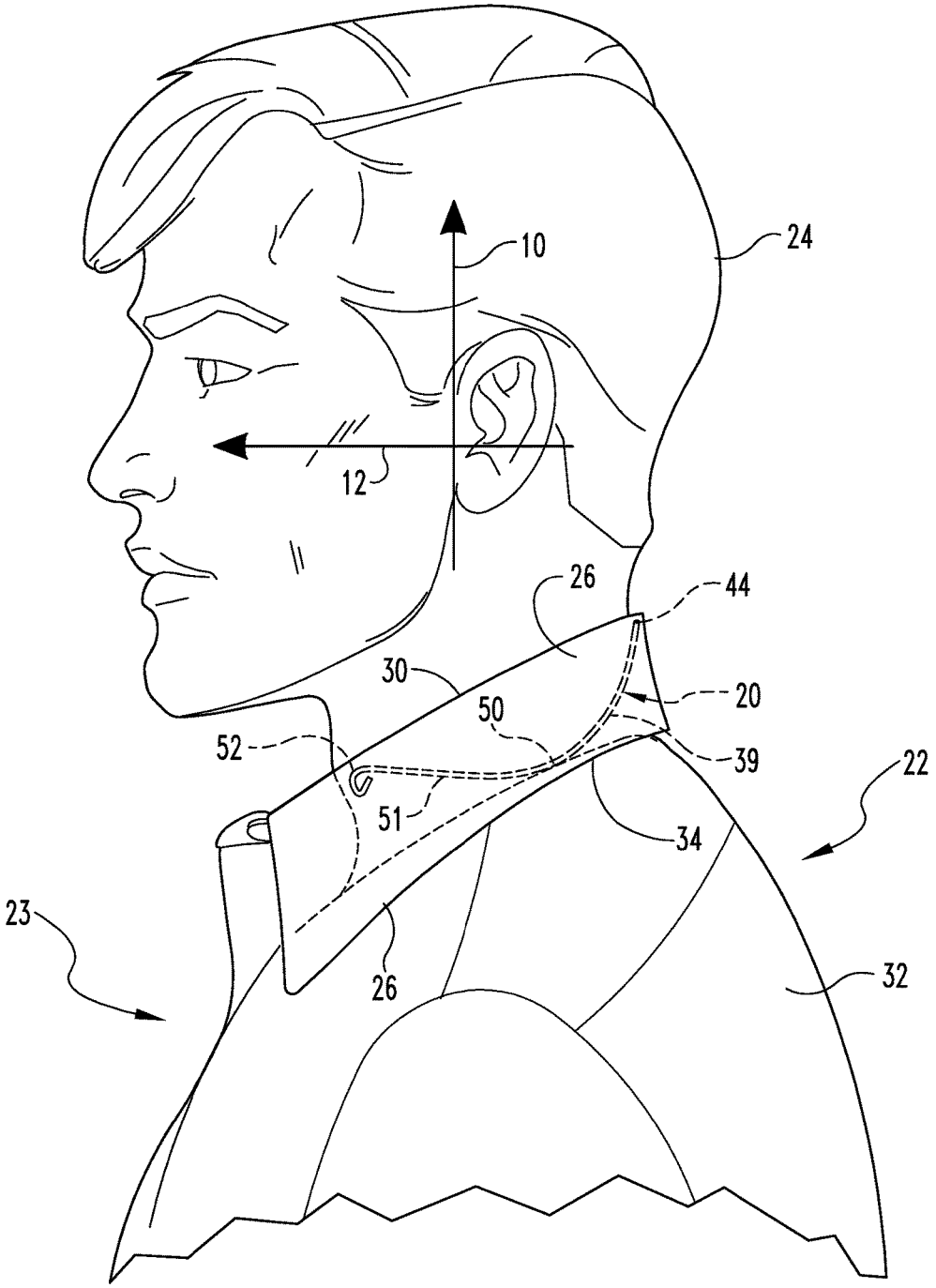
FIG. 3 is a side view of the device in use.
Figure 4:
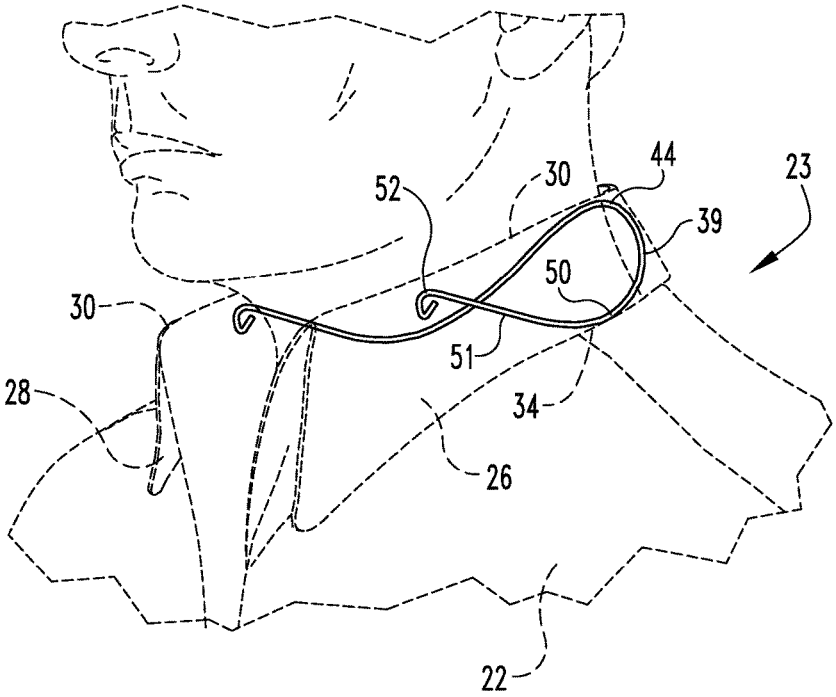
FIG. 4 is a schematic view of the device in use.
Figure 6:
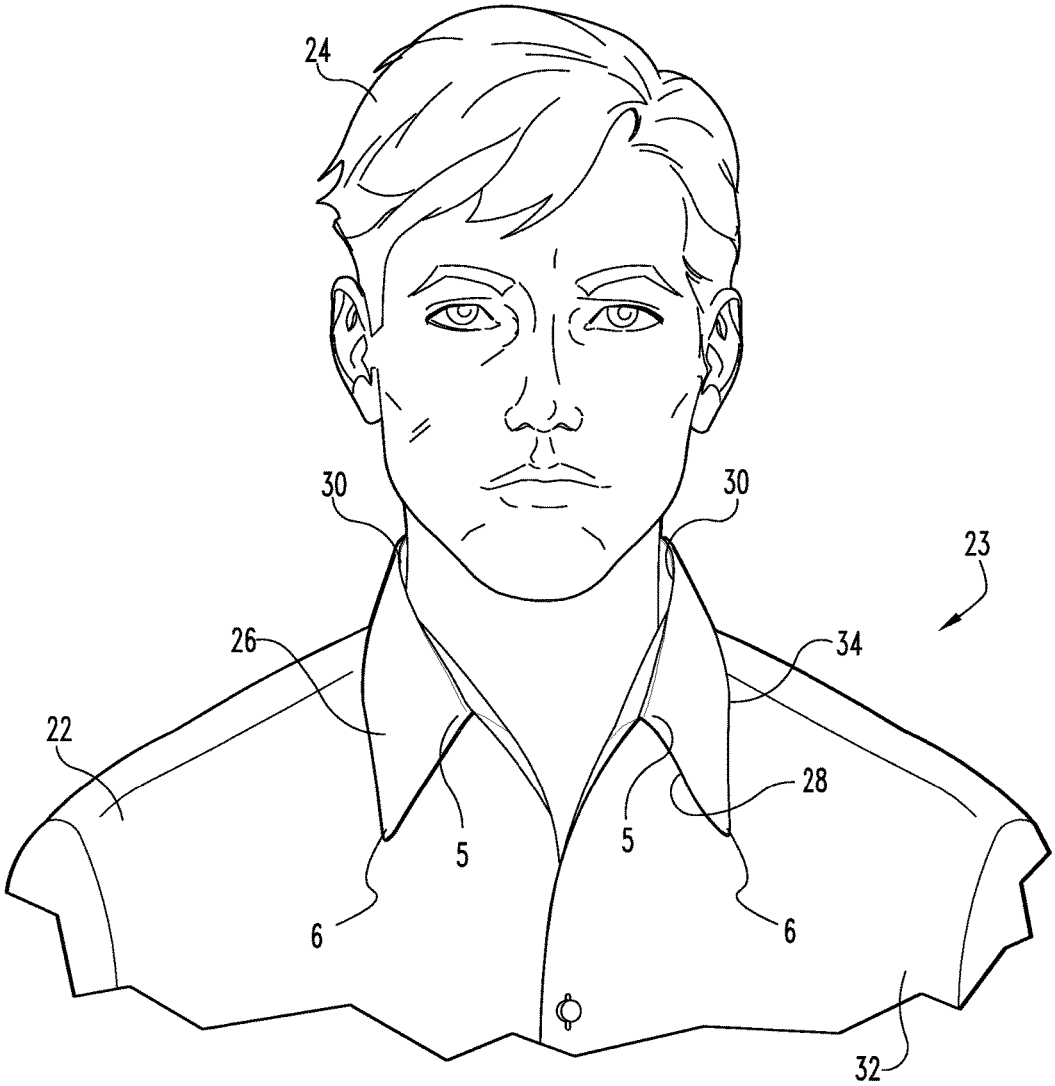
FIG. 6 is a front view of a user wearing a shirt with the device.

A collar shaping device 20 for use with a shirt 22 wearable by a user 24 is shown in FIGS. 1 and 2. A shirt assembly 23 employing device 20 with shirt 22 is shown in FIGS. 3, 4 and 6. The exemplary shirt 22 includes a collar 26 having an underside 28 and an upper crease 30. Upper crease 30 extends along the length of the collar and the collar is folded over at the upper crease 30. The underside 28 of collar 26 faces the body 32 of shirt 22 and is hidden from view when shirt 22 is being worn and collar 26 is folded over along upper crease 30. Shirt body 32 includes all of the shirt 22 except for collar 26 and includes an upper shoulder area 34 disposed under opposite sides of collar 26 and which rests upon the top of the user's shoulders when shirt 22 is being worn. The illustrated shirt 22 is a conventional men's dress shirt, however, device 20 may be used with any shirt having a collar 26 that is folded over.

Collar shaping device 20 is formed out of a length of malleable material that is formed into a U-shape and is adapted to be positioned under collar 26 when shirt 22 is being worn by a user 24. U-shaped body 36 includes an arcuate central portion 38 that is positioned at the back of the user's neck and first and second legs 40, 42 that extend forward from opposite sides of central portion 38. It is noted that relative terms such as up and down and front and back and derivatives thereof, when used herein, refer to the situation where a user 24 is standing upright wearing a shirt assembly 23 such that a line extending from the user's feet to the user's head is a vertical line extending upward and a line extending from the back of the user's head to the user's nose is a horizontal line extending forward. In FIG. 3, line 10 is a vertical line pointing upward and line 12 is a horizontal line pointing forward.

The U-shape of body 36 is best seen in FIG. 1 and this U-shape allows body 36 to wrap around the neck of the user and be positioned under collar 26. Slavish conformation to a U-shape is unnecessary and some deviation is acceptable, what is meant by a U-shaped body as used herein, is that the body is capable of being positioned under a shirt collar 26 about the neck of a user. U-shaped body 36 also undulates in a vertical direction to define a serpentine shape as discussed below.

Central portion 38 is bent not only in the horizontal direction, to form an arc that wraps about the back of the user's neck, but also in the vertical direction to form an upper rear contact region 44 that is adapted to engage the underside 28 of collar 26 at the upper crease 30 at the midpoint 45 of central portion 38. The upper rear contact region 44 engages the collar 26 at the midpoint of the collar at the rear of the user's neck and prevents the collar from sagging. This engagement of the upper rear contact region 44 with the underside 28 of collar 26 also maintains device 20 in proper position as further discussed below.

First and second legs 40, 42 extend from opposite sides of central portion 38 and each have a proximate region 46 that is connected with central portion 38 and a freely extending distal region 48 that defines the two forward ends of device 20. The proximate region 46 of each leg 40, 42 defines a lower contact region 50 that is adapted to engage the upper shoulder area 34 of shirt body 32 to thereby support device 20. The distal region 48 of each leg 40, 42 defines an upper forward contact region 52 adapted to engage the underside 28 of collar 26 at the upper crease 30 near the forward peak 5 of collar 26. Forward contact regions 52 thereby prevent the forward peaks 5 of collar 26 from sagging. It is noted that in FIG. 1, reference numbers 47 indicate the area where central portion 38 transitions to proximate regions 46 and reference numbers 49 indicate the area where the proximate regions transition to distal regions 48.

Because the lower contact regions 50 are located between the upper rear contact region 44 and the upper forward contact regions 52, lower contact regions 50 act as fulcrums not only preventing the downward movement of device 20 by bearing against the upper shoulders of the user but also providing a pivot point that allows the forces acting on upper rear contact region 44 to balance the forces acting on upper forward contact regions 52. In other words, the vertically serpentine shape of U-shaped body 36 as it vertically undulates from the upper forward contact region of the first leg through the lower contact region of the first leg, the upper rear contact region of the central portion, the lower contact region of the second leg to the upper forward contact region of the second leg allows the lower contact regions of the first and second legs to act as fulcrums balancing the forces acting on the U-shaped body.

As best seen in FIG. 4 and other perspective views of the entire device, the vertically serpentine shape of device 20 defines a plurality of alternately facing arcs. A downward facing arc is centered on the upper rear contact region 44, i.e., rear contact region 44 is at the center of a downward facing arc formed by device 20. Rear contact region 44 engages the upper crease of the collar and defines the high point of the downward facing arc. This downward facing arc is positioned between first and second upward facing arcs which are respectively centered on the lower contact regions 50 of the first and second legs 40, 42, i.e., the lower contact region 50 of the first leg 40 is at the center of the first upward facing arc defined by device 20 and the lower contact region 50 of the second leg 42 is at the center of the second upward facing arc defined by device 20. Lower contact regions 50 engage the upper shoulder area 34 of shirt body 32 and define the low point of the upward facing arcs.

This vertically serpentine shape defined by device 20 thereby traverses a consistent vertical distance corresponding to the vertical height between the upper shoulder area 34 and the upper crease 30 of the collar, i.e., the height of the folded collar, as the vertically serpentine shape traverses between the upper forward contact regions 52 and the lower contact regions 50 and between the lower contact regions 50 and the upper rear contact region 44. As mentioned above, the lower contact regions 50 of the first and second legs 40, 42 act as fulcrums balancing forces acting on the upper forward contact regions 52 of the first and second legs 40, 42 and the upper rear contact region 44 of the central portion 38.

Figure 5:
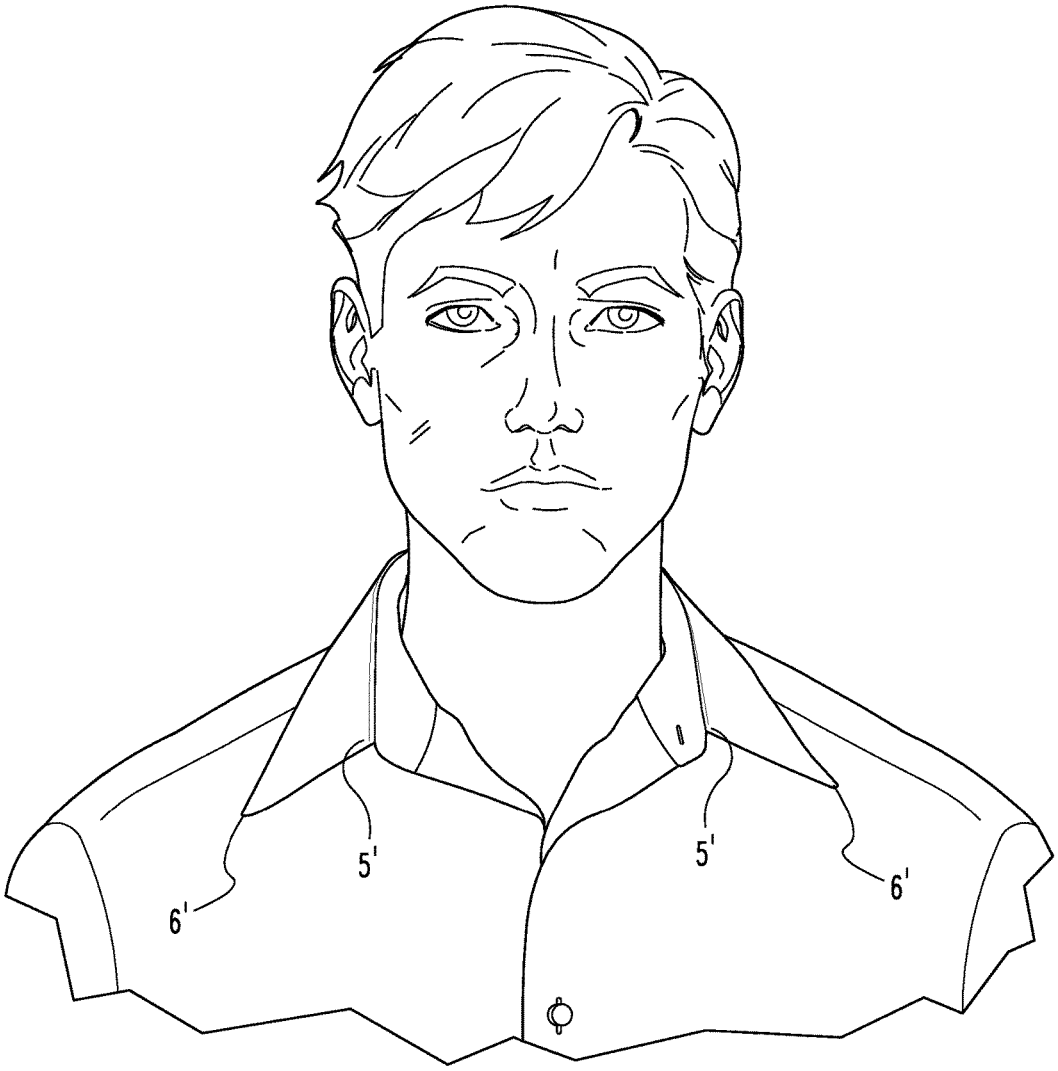
Fig. 5 (Prior Art)
FIG. 5 is a front view of a user wearing a shirt without the device.

The benefits obtainable by using a device 20 can be understood with reference to FIGS. 5 and 6. FIG. 5 illustrates a user wearing a shirt without a device 20. FIG. 5 illustrates the situation wherein, because of the lack of support, the forward peaks 5' of the collar have fallen and the collar points 6' have spread out. FIG. 6 illustrates a shirt assembly 23 that utilizes a device 20 to control the shape and appearance of collar 26. As can be seen in FIG. 6, the forward peaks 5 of collar 26 remain relatively upright and elevated due to the upper forward contact regions 52. Because the peaks 5 are kept in an elevated position, the collar points 6 remain drawn in and do not spread out laterally in the manner shown in FIG. 5.

The vertically serpentine shape of U-shaped body 36 also provides several advantages. For example, forming the lower contact regions 50 out of a downward bend in U-shaped body provides a certain leeway in the precise location where the lower contact regions 50 will bear against the upper shoulder region of the shirt and spreads the bearing engagement over a larger area to thereby avoid the discomfort that might result from a point load on the user's shoulder. The use of upper forward contact regions 52 and upper rear contact region 44 to provide support to the crease of the collar at three spaced apart locations along the length of collar 26 instead of using a member that extends the full length of the collar along the crease also provides advantages. For example, the three upper contact regions prevent collar 26 from sagging while still allowing upper crease 30 of collar 26 to move relatively freely in the spaces between forward contact regions 52 and rear contact region 44. This arrangement facilitates the flexing and movement of the collar during use and thereby provides a comfortable wearing experience for the user.

Device 20 is formed, at least partially, out of a malleable material so that it can be readily adjusted to fit the user. As used herein a malleable material is a material that can be readily reshaped and retain the new shape into which it has been reshaped. In the embodiment of FIGS. 1 and 2, the elongate body that is bent to form U-shaped body 36 is formed entirely out of a malleable material.

As exemplified by directional arrows 64, 66, distal regions 48 of the first and second legs 40, 42 can be manually repositioned relative to each other to thereby adjust the lateral distance 62 between upper contact regions 52. This ability allows the user to adjust the lateral position of the forward ends of collar 26 to a desired position.

Device 20 can also be reshaped whereby distal regions 48 can be repositioned relative to lower contact regions 50 to thereby alter a vertical height between the upper contact regions 52 and the lower contact regions 50. This ability allows the user to adjust the vertical height at which the collar peaks 5 are positioned. The different heights, 68A, 68B, 68C of distal region 48 depicted in FIG. 1 is meant to demonstrate that the distal region can be reposition to alter the height of the upper forward contact regions 52 relative to lower contact regions 50.

By forming central portion 38 out of a malleable material, the arc formed by this portion of the device can also be adjusted to allow for its adjustment by the user to obtain a more precise and comfortable fit.

The entirety of the collar shaping device can be formed out of a malleable material as depicted in FIGS. 1 and 2, or, the malleable material may only be used to form portions of the U-shaped body sufficient to allow for some adjustability of the device. Alternatively, the device may be formed entirely out of a non-malleable material.

Figure 1A:
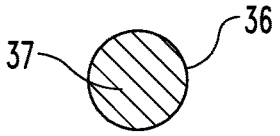
FIG. 1A is a cross section view along line 1A-1A of FIG. 1.

In the embodiment of FIGS. 1 and 2, the entire length of U-shaped body 36 is formed out of a malleable material having a consistent cross sectional profile 37 as depicted in FIG. 1A. In other words, the cross sectional profile of the U-shaped body 36 is the same throughout the entire length of the U-shaped body 36. For example, U-shaped body 36 may be formed out of a length of round metal wire to form a U-shaped body having a consistent cross sectional profile.

As mentioned above, U-shaped body 36 can be formed out of a length of metal wire. Spring steel wire has properties which make it suitable for use as U-shaped body 36. In the illustrated embodiments, an AISI 302/304 stainless steel spring wire meeting the ASTM A 313 standard and having a diameter of 0.625 inches (1.59 cm) is used to form the U-shaped body. Such an AISI 302/304 stainless steel spring wire will have a Modulus of Elasticity (E) of approximately 28 psi$\times 10^6$; a Rockwell Hardness of between C35 and C45; a minimum tensile strength of between 125 and 325 psi$\times 10^3$; and a density of 0.286 lb/in$^3$.

While specific materials for forming U-shaped body 36 are disclosed herein, other materials having suitable physical properties may also be used. The resulting U-shaped bodies 36 may be formed entirely out of a single material or be formed out of multiple materials, e.g., a plastic coated elongate metal wire.

Device 20 only engages the shirt body 32 at the lower contact regions 50. Stated another way, that portion 39 of the U-shaped body 36 which extends between and connects the lower contact regions 50 is configured to be spaced upwardly from the shirt body 32 and those portions 51 of U-shaped body 36 which form first and second legs 40, 42 and are located between the lower contact region 50 and upper contact region 52 are also configured to be spaced upwardly from shirt body 32. It is noted that centrally disposed upwardly spaced portion 39 includes all of central portion 38 and that part of proximate regions 46 between contact regions 50 and central portion 38. By bearing against the user only at the lower contact regions 50, device 20 does not interfere with the user's normal movements and provides a comfortable fit.

In addition to device 20 depicted in FIGS. 1-4, alternative embodiments are depicted in FIGS. 7A, 7B, 7C, 7D and 7E and are discussed below. In the embodiments depicted in FIGS. 2-4, 7A and 7B, the free ends 54, 54A, 54B of the legs 40, 42 are positioned below the upper forward contact regions 52 and extend back toward the central portion 38 when the device is positioned under collar 26 and the shirt is being worn by user.

Figure 7A:
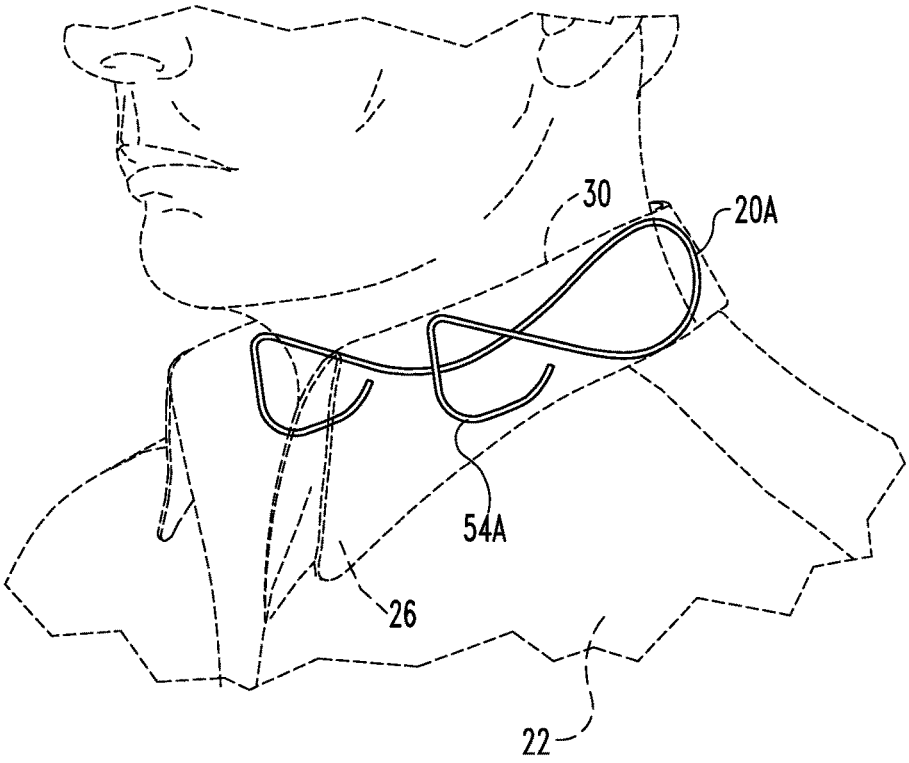
FIG. 7A is a schematic view of an alternative embodiment of the device.
Figure 7B:
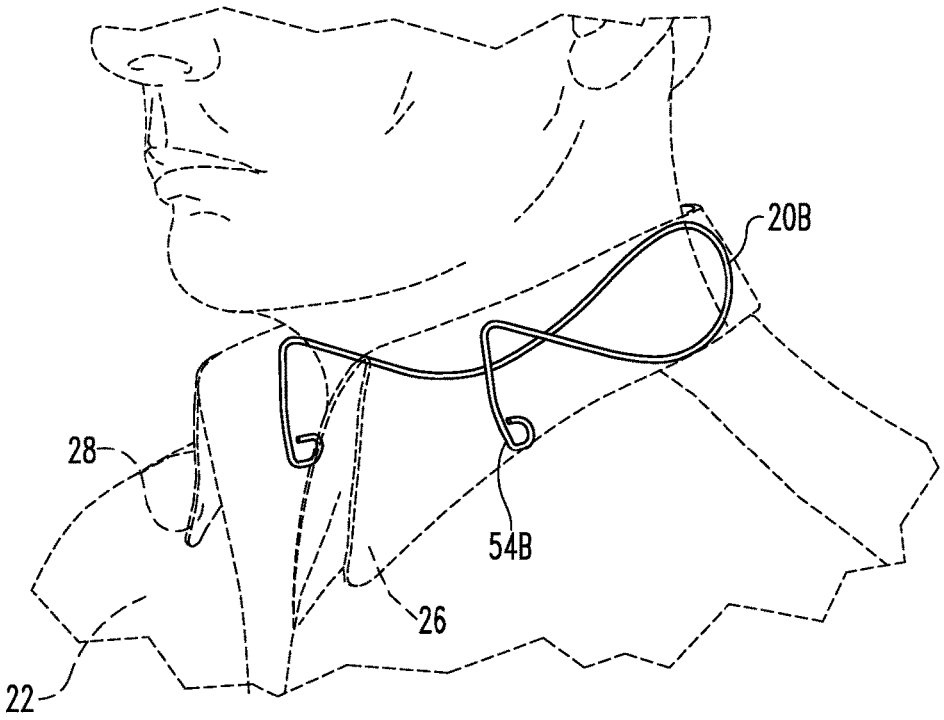
FIG. 7B is a schematic view of another embodiment of the device.
Figure 7C:
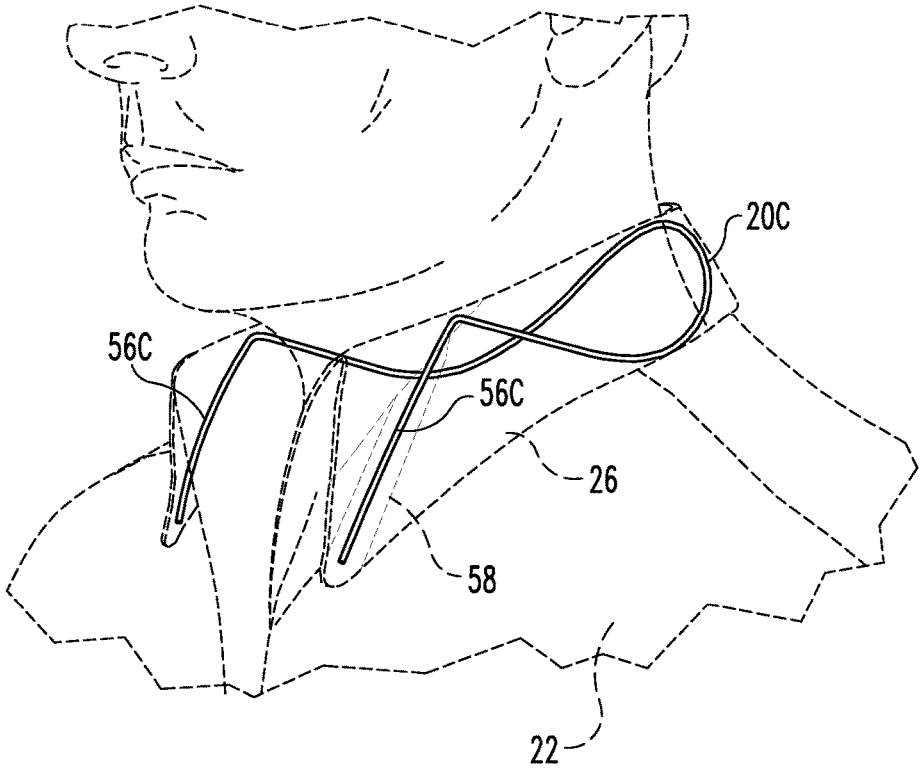
FIG. 7C is a schematic view of another embodiment of the device.
Figure 7D:
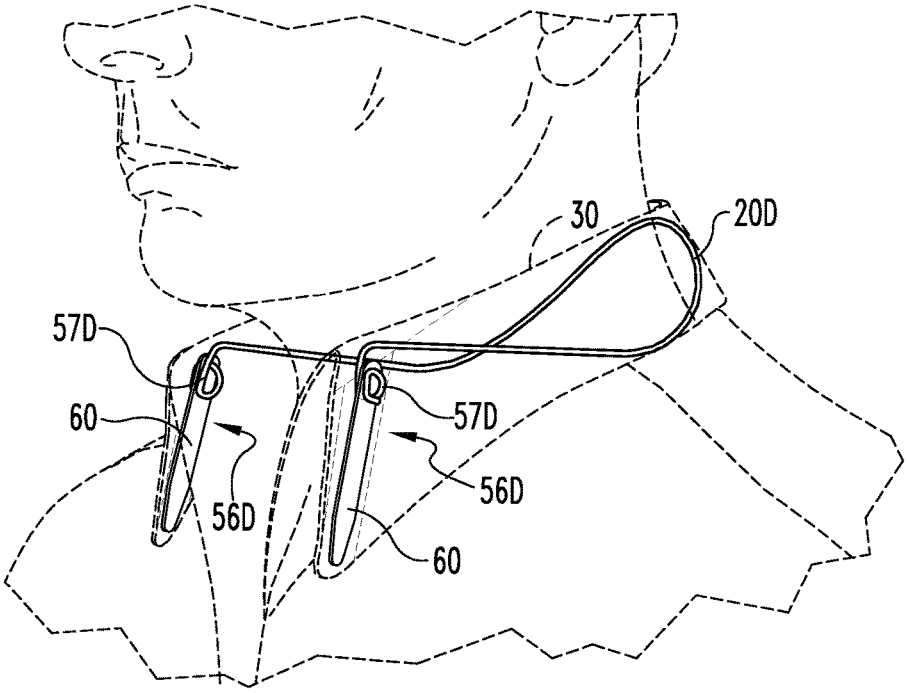
FIG. 7D is a schematic view of another embodiment of the device.
Figure 7E:
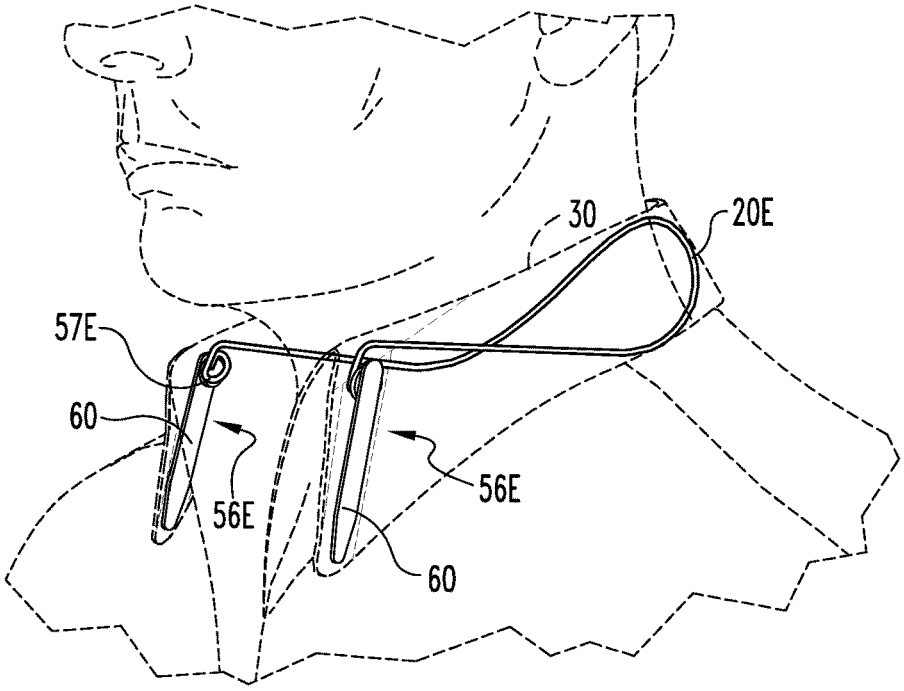
FIG. 7E is a schematic view of another embodiment of the device.
Figure 8:
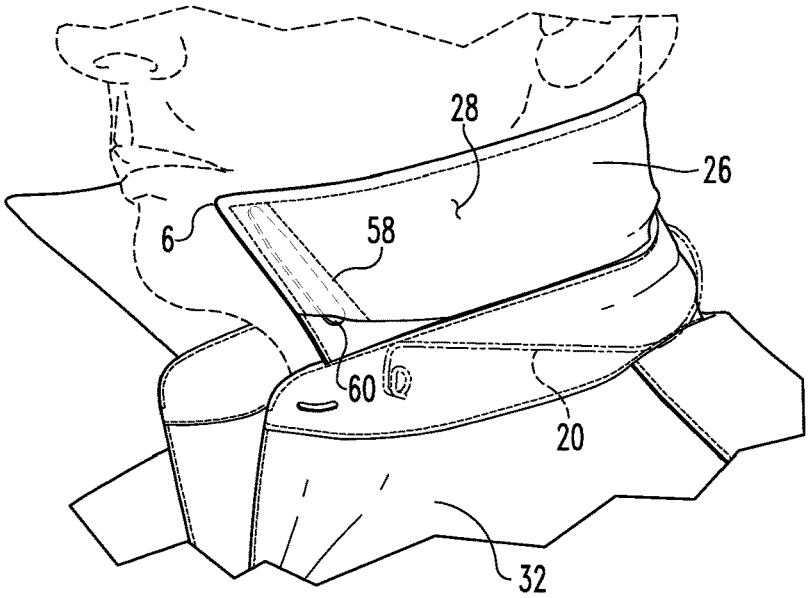
FIG. 8 is a view of an upturned collar showing a collar stay pocket.

In contrast, the devices shown in FIGS. of FIGS. 7C, 7D, 7E, have legs 40, 42 wherein the free ends 56C, 56D, 56E extend downward form the upper forward contact region 52 toward the shirt body 32 and forward away from the central portion 38 whereby the free ends 56C, 56D, 56E are adapted to be inserted into collar stay pockets 58 located on the underside 28 of collar 26. FIG. 8 provides a view of a popped up collar that has a collar stay pocket showing the underside 28 and collar stay pocket 58. A dashed line is used to indicate the position where device 20 would be installed. As exemplified by FIG. 8, device 20 can be used with a shirt having a traditional collar stay 60 located in a collar stay pocket 58 wherein device 20 is not directly engaged with collar stay 60.

Turning now to a discussion of the individual embodiments of FIGS. 7A-7E, FIG. 7A discloses a collar shaping device 20A wherein the free end 54A extends downwardly to a position proximate shirt body 34 to provide additional support to upper forward contact region 52. Extending the free end of the device downwardly toward the shirt body also provides a mechanism whereby the lateral position of the lower portion of the collar, such as collar point 6, can be more directly controlled. Embodiments 7C, 7D and 7E provide an enhanced lateral control of the collar points 6 by integrating a collar stay into the device or by inserting a portion of the device into the collar stay pockets of the shirt.

FIG. 7B shows a collar shaping device 20B that also provides additional support to upper forward contact region 52 but utilizes a free end 54B that is smaller than free end 54A and which can be secured to the lower edge of collar 26. For example, a portion of the free end 54B could be positioned on the exterior of collar 26 to secure it in place. Alternatively, an adhesive, magnets, or tape could be used to secure free end 54B to collar 26 or a collar stay disposed within a pocket on collar 26 while maintaining free end 54B on the inside of collar 26 to keep it from being seen.

FIG. 7C illustrates a collar shaping device 20C wherein the free ends 56C can be inserted into pockets 58 on the underside 28 of collar 26 normally used for receiving collar stays. Device 20C thereby provides additional control of the shape and angle of the collar proximate the collar peak 5 and collar points 6.

FIGS. 7D and 7E disclose collar shaping devices 20D, 20E that have collar stays 60 attached thereto. Collar stays 60 may take the form of conventional plastic collar stays commonly used with dress shirts. Device 20D has legs 40, 42 with freely extending ends 56D that are formed by collar stays 60 and a bent wire end 57D that functions like a paperclip to grip one end of collar stay 60. Device 20E is similar to Device 20D but has bent wire ends 57E near the upper forward contact regions 52 that are secured to collar stays 60 using adhesive, magnets or other suitable means.

It is noted that the embodiments depicted in FIGS. 7C and 7E may be readily modified to utilize magnets to enhance the control of the front edge of collar 26 between collar peak 5 and collar point 6. For example, embodiment 20C depicted in FIG. 7C could be formed out of a ferrous metal whereby it was attracted to a magnet. Then, instead of inserting the distal end of device 20C into the collar stay pockets 58, a collar stay similar in shape to collar stay 60 but having embedded magnets in opposite ends of the collar stay could be inserted into collar stay pockets 58. The magnetic collar stay would then be attracted to free end 56C and held in alignment therewith. By bending the free end 56C, the position not only of collar peak 5, but also collar point 6 could then be controlled and adjusted thereby providing precise lateral control of the location of collar points 6. It is noted that a collar stay having an embedded magnet at its upper end could be used to magnetically secure the top end of the collar stay to embodiments 20D and 20E simply by forming the distal ends of devices 20D and 20E out of a ferrous metal. Alternatively, the magnetic attachments described above could be provided by utilizing collar stay 60 formed out of a ferrous metal and attaching a magnet to the collar shaping device or forming the collar shaping device out of a magnetic material.

A method of shaping a collar on a shirt being worn by a user will now be discussed. The method includes providing an elongate body 36 and forming the elongate body into a U-shape having a central portion 38 and first and second legs 40, 42 extending from opposite sides of the central portion 38. As discussed above, the U-shaped body 36 may be advantageously formed out of a length of malleable metal wire.

The method also involves engaging the underside 28 of the collar 26 at the upper crease 30 of the collar at the midpoint 45 of the U-shaped body with an upper rear contact region 44 of the central portion to thereby bias upwardly the midpoint of the collar at the back of the user's neck. The underside 28 of the collar at the upper crease 30 proximate opposite ends 5 of the collar is also biased upwardly by engaging the collar with upper forward contact regions 52 disposed on distal regions 48 of the first and second legs 40, 42 of the device. The method also includes engaging the shirt body 32 at the upper shoulder areas 34 with lower contact regions 50 disposed on proximate regions 46 of the first and second legs 40, 42 to thereby provide a support for the U-shaped body. The lower contact region 50 of the first leg is disposed between the upper forward contact region 52 of the first leg and the upper rear contact region 44 while the lower contact region 50 of the second leg is disposed between the upper forward contact region 52 of the second leg and the upper rear contact region 44 whereby the engagement of the lower contact regions 50 with the shirt body act as a fulcrum with forces generated by the engagement of the upper rear contact region 44A balancing forces generated by the engagement of the upper forward contact regions 52A.

In this regard, it is noted that, in FIG. 2, the downward forces acting on upper rear contact region 44 are schematically depicted by arrow 44A, the downward forces acting on upper forward contact regions 52 are schematically depicted by arrow 52A and the upward forces acting on lower contact region 50 are schematically depicted by arrow 50A. It is additionally noted that although FIG. 2 does not show device 20 in use, the schematically depicted forces are the forces that will act on device 20 when it is positioned underneath a collar 26 of a shirt being worn by a user 24.

While this invention has been described as having an exemplary design, the present invention may be further modified within the spirit and scope of this disclosure. This application is therefore intended to cover any variations, uses, or adaptations of the invention using its general principles.

What is claimed is:

1. A collar shaping device for use with a shirt wearable by a user, the shirt having a collar and a shirt body, the collar having an underside facing the shirt body and an upper crease along which the collar is folded, the shirt body including upper shoulder regions disposed under opposite sides of the collar when the shirt is being worn by a user, the device comprising: a U-shaped body adapted to be positioned under the collar when the shirt is being worn by the user;

the U-shaped body defining a central portion and first and second legs extending from opposite ends of the central portion;

the central portion defining an upper rear contact region adapted to engage the underside of the collar at the upper crease of the collar at a midpoint of the central portion;

wherein the first and second legs each have a proximate region connected with the central portion and a distal region having a free end, the proximate region of each of the first and second legs defining a lower contact region adapted to engage the upper shoulder area of shirt body, the distal region of each of the first and second legs defining an upper forward contact region adapted to engage the underside of the collar at the upper crease of the collar; and wherein the U-shaped body undulates in a vertical direction from the upper forward contact region of the first leg through the lower contact region of the first leg, the upper rear contact region of the central portion, the lower contact region of the second leg to the upper forward contact region of the second leg to thereby define a vertically serpentine shape, wherein the vertically serpentine shape defines a plurality of alternately facing arcs with a downward facing arc centered on the upper rear contact region and first and second upward facing arcs respectively centered on the lower contact regions of the first and second legs, the vertically serpentine shape traversing a consistent vertical distance between the upper forward contact regions and the lower contact regions and between the lower contact regions and the upper rear contact region and wherein the lower contact regions of the first and second legs act as fulcrums balancing forces acting on the upper forward contact regions of the first and second legs and the upper rear contact region of the central portion.

2. The collar shaping device of claim 1 wherein the U-shaped body defines a length, the U-shaped body having a consistent cross sectional profile along the length of the U-shaped body.

3. The collar shaping device of claim 2 wherein the U-shaped body is formed by an elongate, malleable, metal material.

4. The collar shaping device of claim 3 wherein the U-shaped body is formed by a spring steel wire.

5. The collar shaping device of claim 4 wherein the U-shaped body is formed by an American Iron and Steel Institute (AISI) 302/304 stainless steel wire having a diameter of 0.625 inches.

6. The collar shaping device of claim 1 wherein, when the U-shaped body is positioned under the collar when the shirt is being worn by the user, the free ends of the distal regions of the first and second legs are configured to extend downward from the upper forward contact region toward the shirt body and back toward the central portion.

7. The collar shaping device of claim 1 wherein, when the U-shaped body is positioned under the collar when the shirt is being worn by the user, the free ends of the distal regions of the first and second legs are configured to extend downward from the upper forward contact region toward the shirt body and forward away from the central portion whereby the free ends are adapted to be inserted into collar stay pockets located on the collar.

8. The collar shaping device of claim 1 wherein the U-shaped body is at least partially formed out of a malleable material and can be manually reshaped whereby the distal regions can be repositioned relative to each other to thereby alter a lateral distance between the upper contact regions of the first and second legs.

9. The collar shaping device of claim 1 wherein the U-shaped body is at least partially formed out of a malleable material and can be manually reshaped.

10. The collar shaping device of claim 9 wherein the U-shaped body can be manually reshaped whereby the distal regions can be repositioned relative to each other to thereby alter a lateral distance between the upper contact regions of the first and second legs.

11. The collar shaping device of claim 1 wherein, when the U-shaped body is positioned under the collar when the shirt is being worn by the user, the U-shaped body extending between and connecting the lower contact regions is configured to be spaced upwardly from the shirt body.

12. The collar shaping device of claim 11 wherein, when the U-shaped body is positioned under the collar when the shirt is being worn by the user, the U-shaped body forming the first leg between the lower contact region and the upper contact region and the U-shaped body forming the second leg between the lower contact region and the upper contact region are configured to be spaced upwardly from the shirt body.

13. A shirt assembly adapted to be worn by a user, the shirt assembly comprising:

a shirt having a collar and a shirt body, the collar having an underside facing the shirt body and an upper crease along which the collar is folded, the shirt body including upper shoulder regions disposed under opposite sides of the collar when the shirt is being worn by a user; and a collar shaping device having a U-shaped body positioned under the collar when the shirt assembly is being worn by the user, the U-shaped body defining a central portion and first and second legs extending from opposite ends of the central portion;

the central portion defining an upper rear contact region engaging the underside of the collar at the upper crease of the collar at a midpoint of the central portion;

wherein the first and second legs each have a proximate region connected with the central portion and a distal region having a free end, the proximate region of each of the first and second legs defining a lower contact region engaging the upper shoulder area of shirt body, the distal region of each of the first and second legs defining an upper forward contact region engaging the underside of the collar at the upper crease of the collar; and wherein the U-shaped body undulates in a vertical direction from the upper forward contact region of the first leg through the lower contact region of the first leg, the upper rear contact region of the central portion, the lower contact region of the second leg to the upper forward contact region of the second leg to thereby define a vertically serpentine shape, wherein the vertically serpentine shape defines a plurality of alternately facing arcs with a downward facing arc centered on the upper rear contact region and first and second upward facing arcs respectively centered on the lower contact regions of the first and second legs, the vertically serpentine shape traversing a consistent vertical distance between the upper forward contact regions and the lower contact regions and between the lower contact regions and the upper rear contact region and wherein the lower contact regions of the first and second legs act as fulcrums balancing forces acting on the upper forward contact regions of the first and second legs and the upper rear contact region of the central portion.

14. The shirt assembly of claim 13 wherein the U-shaped body defines a length, the U-shaped body having a consistent cross sectional profile along the length of the U-shaped body.

15. The shirt assembly of claim 14 wherein the U-shaped body is formed by an elongate, malleable, metal material.

16. The shirt assembly of claim 15 wherein the U-shaped body is formed by a spring steel wire.

17. The shirt assembly of claim 16 wherein the U-shaped body is formed by an American Iron and Steel Institute (AISI) 302/304 stainless steel wire having a diameter of 0.625 inches.

18. The shirt assembly of claim 13 wherein, when the U-shaped body is positioned under the collar when the shirt is being worn by the user, the free ends of the distal regions of the first and second legs extend downward from the upper forward contact region toward the shirt body and forward away from the central portion whereby the free ends are inserted into collar stay pockets located on the collar.

19. The shirt assembly of claim 13 wherein the U-shaped body is at least partially formed out of a malleable material and can be manually reshaped whereby the distal regions can repositioned to thereby alter a lateral distance between the upper contact regions of the first and second legs.

20. The shirt assembly of claim 13 wherein, when the U-shaped body is positioned under the collar when the shirt is being worn by the user, portions of the U-shaped body extending between and connecting the lower contact regions, forming the first leg between the lower contact region and the upper contact region, and forming the second leg between the lower contact region and the upper contact region, are spaced upwardly from the shirt body.

21. A method of shaping a collar on a shirt being worn by a user, the shirt further including a shirt body with upper shoulder areas disposed under opposite sides of the collar, the collar having an underside facing the shirt body and an upper crease along with the collar is folded; the method comprising:

providing an elongate body;

forming the elongate body into a U-shaped body having a central portion and first and second legs extending from opposite sides of the central portion;

forming vertical undulations in the U-shaped body wherein the U-shape body undulates in a vertical direction from an upper forward contact region of the first leg through a lower contact region of the first leg, an upper rear contact region of the central portion, a lower contact region of the second leg to an upper forward contact region of the second leg to thereby define a vertically serpentine shape;

engaging the underside of the collar at the upper crease of the collar at the midpoint of the collar with the upper rear contact region of the central portion to thereby bias the midpoint of the collar upwardly;

engaging the underside of the collar at the upper crease of the collar proximate opposite ends of the collar with the upper forward contact regions disposed on the first and second legs of the U-shaped body to thereby bias the opposite ends of the collar upwardly; and engaging the shirt body at the upper shoulder areas with the lower contact regions disposed on the first and second legs to thereby provide a support for the U-shaped body, the lower contact region of the first leg being disposed between the upper forward contact region of the first leg and the upper rear contact region, the lower contact region of the second leg being disposed between the upper forward contact region of the second leg and the upper rear contact region whereby the engagement of the lower contact regions with the shirt body act as a fulcrum with forces generated by the engagement of the upper rear contact region balancing forces generated by the engagement of the upper forward contact regions; and wherein the vertically serpentine shape defines a plurality of alternately facing arcs with a downward facing arc centered on the upper rear contact region and first and second upward facing arcs respectively centered on the lower contact regions of the first and second legs, the vertically serpentine shape traversing a consistent vertical distance between the upper forward contact regions and the lower contact regions and between the lower contact regions and the upper rear contact region and wherein the lower contact regions of the first and second legs act as fulcrums balancing forces acting on the upper forward contact regions of the first and second legs and the upper rear contact region of the central portion.

22. The method of claim 21 wherein the step of providing an elongate body comprises providing a length of malleable metal wire.

* * * * *